US006375242B1

(12) United States Patent
Zingerman

(10) Patent No.: US 6,375,242 B1
(45) Date of Patent: Apr. 23, 2002

(54) LOAD CLIPPING DEVICE FOR CRANE

(76) Inventor: David Zingerman, 1615 Wilcox Ave., Los Angeles, CA (US) 90068

( * ) Notice: Subject to any disclaimer, the term of this patent is extended or adjusted under 35 U.S.C. 154(b) by 0 days.

(21) Appl. No.: 09/661,530

(22) Filed: Sep. 14, 2000

(51) Int. Cl.[7] ..... B66C 1/36
(52) U.S. Cl. ..... 294/82.3; 294/82.31
(58) Field of Search ..... 294/75, 82.13, 294/82.17, 82.19–82.21, 82.27, 82.3, 82.31, 82.33–82.35; 24/598.4, 598.7, 599.1, 599.5–599.7, 599.9, 600.1, 600.3

(56) References Cited

U.S. PATENT DOCUMENTS 2,666,664 A * 1/1954 Johnson ..... 294/82.33
3,964,777 A * 6/1976 Lindqvist ..... 294/82.3
3,971,478 A 7/1976 Matasa
4,073,531 A * 2/1978 Androski ..... 294/82.3
4,360,230 A * 11/1982 Wood et al. ..... 294/82.3 X
4,609,219 A * 9/1986 Go ..... 294/82.33 X
4,664,559 A * 5/1987 Berrang ..... 294/82.3 X
5,688,009 A 11/1997 Pienta
5,765,891 A 6/1998 Fredriksson

* cited by examiner

*Primary Examiner*—Johnny D. Cherry

(57) ABSTRACT

A load clipping device provides a possibility of the tall building material (construction) safe lifting and quick rigging. An improved load clipping device includes a clipping device body, a locking hook connected by the main hinge to the clipping device body and by a second hinge to a lever, a main spring connected to the locking hook and coupled with the clipping device body, an electromagnet, comprising a coil connected to the clipping device body and a core connected by the second hinge to the locking hook and to an insert installed into the cavity located in the end of the short lever of the locking hook and having a semicircular cogwheel, and wherein the lever, having a hollow configuration and connected by the second hinge to the locking hook, includes a spring housed inside the lever and a cog connected by a third hinge to the spring.

4 Claims, 2 Drawing Sheets

LOAD CLIPPING DEVICE FOR CRANE

FIELD OF THE INVENTION

This invention relates to the load clipping devices for cranes and more particularly to the crane remote controlled load clipping and load accidental release prevention devices.

BACKGROUND OF THE INVENTION

The various types of the load clipping devices for crane hook are well known. The release of the heavy and large size (tall) construction structures with the small basis square, lifted by construction crane, is a difficult operation, requiring the high qualification of the crane operator and rigger. In order to provide effective and safety load release, the most crane hooks have supplementary equipment. For example, the hook by U.S. Pat. No. 5,688,009 includes the longitudinally extending frame member which is attached to a moveable arm of the material handling lift. A longitudinally extending probe is positioned below and parallel to the frame member. An end frame member is positioned between the upper frame member and the probe. A pusher arm is mounted for movement along the probe to urge items being carried by the probe to new predetermined positions.

A probe, which in this embodiment is a cylindrical rod, is positioned below and parallel to the frame member. The frame member and probe are joined together by an end assembly. A moveable arm is connected to the frame member by a pair of mounting plates. A longitudinally extending screw is journaled by bearings within the frame member. A motor is mounted on the end assembly and includes an output shaft, which mounts a pulley. Another pulley is operatively connected to the screw. A drive belt extends between the pulleys. Operation of the motor drives or rotates the screw. The screw is an Acme screw. The device also includes a pusher arm. The pusher arm has a pusher plate. A lower end of the pusher plate is complementary with the circumference of the cylindrical probe. The pusher arm depends on a pusher block which in turn is carried by the screw. The pusher block defines a threaded opening which mates with threads defined by the screw.

In operation, the moveable arm of the power lift material handling apparatus is positioned where, for example, the free end of the probe receives, for instance, the center openings of a plurality of paper rolls. The plurality of paper rolls are aligned along the probe. When in the initial position, the pusher arm is generally moved to its rearward position, adjacent the frame end. This is accomplished by energizing the motor and rotating the screw. The threaded engagement with the screw moves the pusher block and the attached pusher arm to the desired position. The arm can then be moved to another position. At that time, all of the rolls may be released from the probe by moving the pusher arm to the left.

Such devices can not provide the safe lifting of the large-size (tall) loads, having oscillation (swaying) effect, considering the presence of the open (unlocking) portion of the load clipping C-hook.

Another device by the U.S. Pat. No. 3,971,478 comprises a load trolley moving on tracks fitted to the steel bridge of the overhead crane. On top of the load trolley there is a circular track on which there is a rotatable crab provided with a swivelling mechanism, hoist mechanism, a lifting beam provided with C-shaped claws, and a tilting mechanism for the beam and claws. The load carrier system includes the C-shaped claws featuring the tilting movement, and is equipped with from one to four lifting magnets and lifting hooks, the lifting beam assembly being suspended on the auxiliary beam by means of linking pin members. These pin members are for the dismantling of the lifting load, e.g. the handling of rolled products stored on racks; in this case the load is taken by means of a hook. The mentioned device also comprises the pairs of ropes 1, as well as two other ropes being provided for lifting and lowering the auxiliary load beam.

The ropes have their starting ends secured to the frame of the rotatable crab and their opposite ends, after being entrained over balance pulleys, which are located with their axis of rotation passing through the longitudinal center-line of the auxiliary beam, are directly entrained over guide pulleys and finally are wound round the section threaded with double thread of the drums which are mounted centrally on the rotatable crab. Each of the balance pulleys includes multiple sheaves to receive the respective pair of ropes. The starting ends of the cables are secured on the frame of the rotatable crab and their opposite ends after being entrained on balance pulleys installed on the auxiliary beam with their axis of rotation normal to the longitudinal center-line of the auxiliary beam, and then are guided by three pairs of guiding pulleys, being then normally brought to the same drums provided with double thread sections where the ropes are finally wound. Also the lifting beam is provided with C-shaped claws, the latter being attached by the wire ropes arranged at an inclined pattern. The starting ends of the wire ropes are normally brought to the same drums after being entrained on three pairs of guide pulleys. The final ends of the ropes are entrained on an assembly of balance pulleys, whose center of rotation is located sidewise at a distance from the longitudinal center-line of the lifting beam; however, the mentioned assembly is situated in height as nearly as possible to the horizontal plane passing through the centers of rotation of the balance pulleys secured to the auxiliary beam. The ropes are afterwards entrained over the other guide pulleys and are finally wound around the section of the drum provided with double threading of the tilting mechanism located on the rotatable crab. The assembly of balance pulleys is attached by means of hinged attaching members sidewise at a distance from the longitudinal center-line of the lifting beam.

The electrical control cab is suspended on the rotatable crab by means of a steel structure which is provided inside with stairs for the direct access thereto of crane operators from the control cab to the rotatable crab.

Such devices are complex and expensive.

Some crane hooks have a pivotable closure member (locking lever), as it is described, for example, in the U.S. Pat. No. 5,765,891, wherein the lever can be retracted into the hook opening thereby unlocking the hook. The crane hook by the mentioned patent includes a bridge portion of the shank, which extends across a slot between the shank portions so as to connect the two shank portions to each other and to divide the slot into an upper slot part and a lower slot part. The upper slot part is provided with an anchoring member extending transversely between the two shank portions for securely anchoring an end link of the hoisting chain to the shank of the hook. The lower slot part has an insertion opening, into which a desired link of the hoisting chain can be inserted and be displaced into the centrally located position adjacent to said bridge portion and the recessed seating surfaces are located at the lower slot part adjacent to the bridge portion and are oriented so that the engagement link, when engaging the recessed seating surfaces, projects transversely away from the upper shank so as to form a loose, non-loaded loop of the hoisting chain between the anchored end link and the engagement link.

These devices require the use of a non-standard crane hook, having a complex and expensive modernization.

Thus, there is a great need in the art for a crane load clipping device, providing not complex remote controlled load clipping and load accidental release prevention devices.

OBJECT AND ADVANTAGES OF THE INVENTION

Accordingly, several objects and advantages of the present invention are to provide the cranes with the remote controlled load clipping devices.

It is another object of the invention to increase the safety of the lifting processes.

It is still another object of the invention to provide the load accidental release prevention.

It is further object of the invention to decrease the rigging operation time.

It is still further object of the invention to increase the efficiency of the tall building material (construction) installation.

DESCRIPTION OF THE DRAWING

In order that the invention and the manner in which it is to be performed may be more clearly understood, embodiments thereof will be described by way of example with reference to the attached drawings, of which.

SUMMARY OF THE INVENTION

This invention provides a possibility of the tall building material (construction) safe lifting and quick rigging. An improved load clipping device includes a clipping device body, a locking hook connected by the main hinge to the clipping device body and by a second hinge to a lever, a main spring connected to the locking hook and coupled with the clipping device body, an electromagnet, comprising a coil connected to the clipping device body and a core connected by the second hinge to the locking hook and to an insert, having a semicircular cog-wheel, installed into the cavity located in the end of the short lever of the locking hook. The lever, having a hollow configuration and connected to the locking hook by the second hinge, includes a spring housed inside the lever and a cog connected by a third hinge to the spring.

DESCRIPTION OF THE PREFERRED EMBODIMENTS

Figure 1:
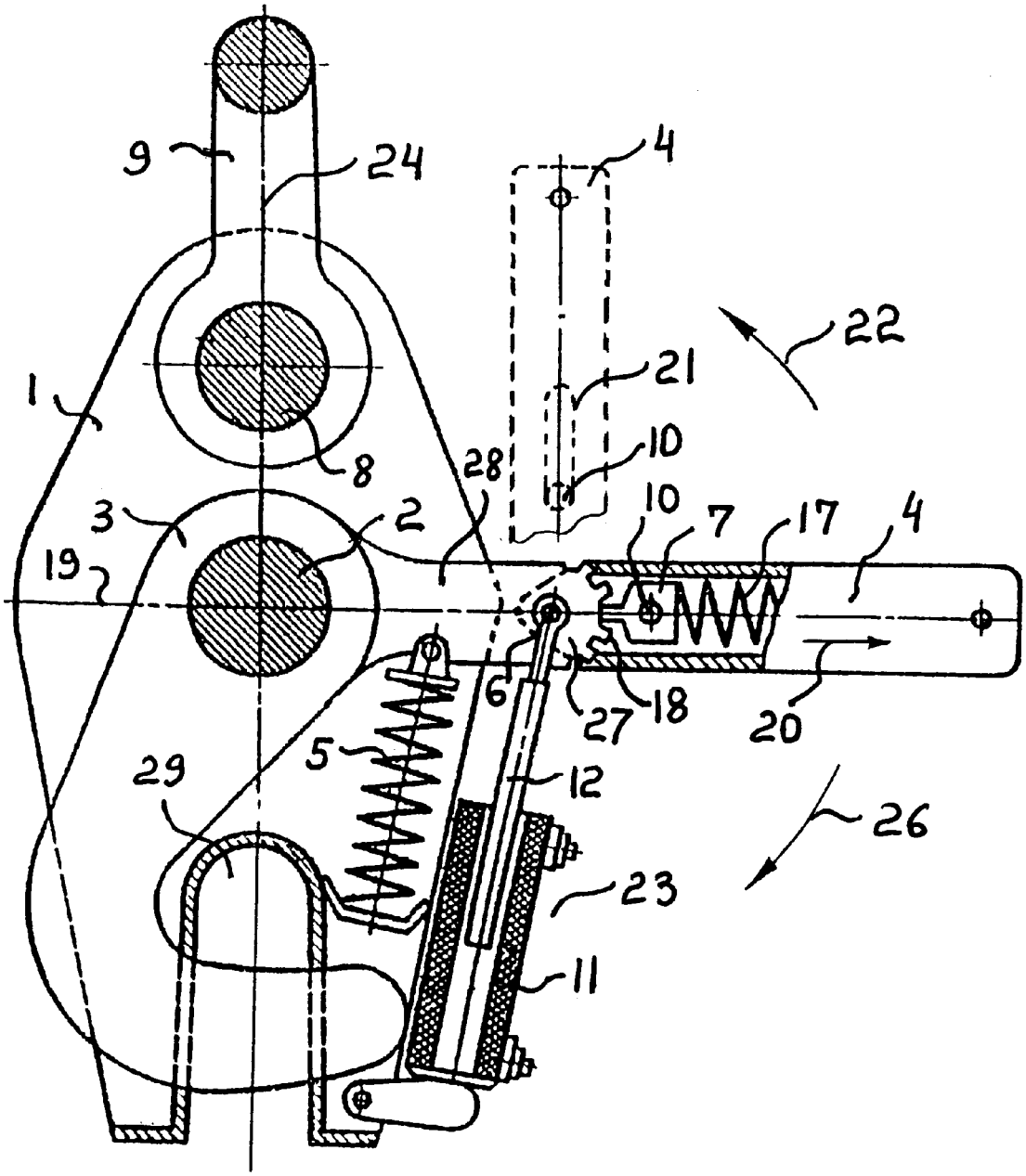
FIG. 1 is a simplified drawing of an improved load clipping device.
Figure 2:
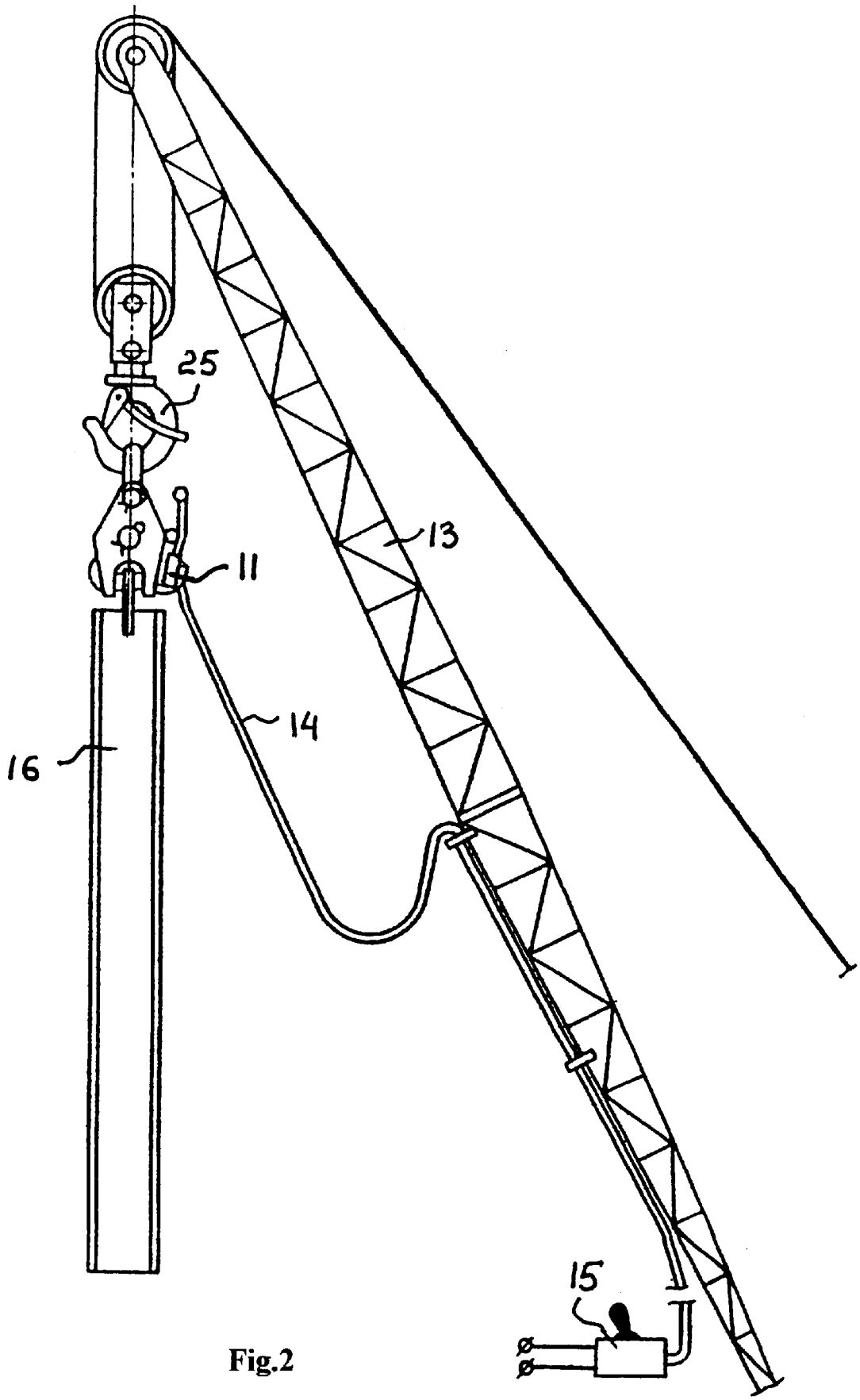
FIG. 2 is a simplified representation of the crane with a load clipping device.

Referring to FIG. 1, an improved load clipping device includes a clipping device body 1, and a locking hook 3, having a short lever 28. The locking hook 3 is by the main hinge 2 connected to the body 1 and by the second hinge 6 to a lever 4. Also the clipping device comprises a main spring 5 connected to the locking hook 3 and coupled with the body 1, an electromagnet 23, comprising a coil 11 connected to the body 1 and a core 12 connected by the second hinge 6 to the locking hook 3 via an aperture in the insert 27 installed into the cavity located in the end of the short lever 28. The one side of the insert 27 has a semicircular cog- wheel 18 in vertical plane and another side (inserting side) can have any configuration, for example, regular geometric forms (triangular, rectangular, etc) except circular form or any irregular form (e.g. excentrical, as shown on FIG. 1) and can be oriented in any reasonable plane depending on orientation of the cavity (e.g. in vertical plane, as shown in FIG. 1). The lever 4, having a hollow, includes a spring 17 housed inside the lever 4 and a cog 7 connected by a third hinge 10, to the spring 17. Also, the load clipping device comprises a lug (suspension shackle) 9 connected by a fourth hinge 8 to the body 1 and an electrical wire 14 (see FIG. 2), connecting the coil 11 of the electromagnet 23 with the switch 15.

The short lever 28 of the locking hook 3 is located along the lateral axis 19 directed perpendicularly (angle of 90°) to the clipping device axis 24. The butt-end of the short lever 28 of the locking hook 3 has a cavity, in which is installed the motionless insert 27, having the mentioned semicircular cog-wheel 18. The horizontal position of the lever 4 can be changed to the more ergonomically convenient position for a slinging operator (slinger, rigger) by pulling the third hinge 10, jutting out of the lever body, along the slot 21 in the direction to the "free" end of the lever 4 (for example, along the axis 19 in the direction 20), thereby releasing the fixation of the cog 7 with the semicircular cog-wheel 18, and by shifting lever 4 down in the direction 26 or up in direction 22. When the convenient position of the lever 4 is selected, the rigger releases the third hinge 10, fixating the lever 4 position.

The improved load clipping device operates as follows. For rigging of the load 16, the rigger by the lug 9 connects the load clipping device to the crane hook 25 (see FIG. 2) and pushes the lever 4 down in the direction 26 (see FIG. 1), moving the locking hook 3 and opening the U-slot 29 for load sling (not shown). After the load sling is placed inside of the U-slot 29 of the clipping device body 1, the rigger releases the lever 4 and the locking hook 3 under action of the main spring 5 is returned to the initial locked position. Then the rigger, pulling the third hinge 10 along the lever slot 21 in the direction 20, pushes the lever 4 up in the direction 22 to the vertical position (dash-line image of the lever 4 on FIG. 1), providing the decreasing of the clipping device lateral (horizontal) size and load accidental release prevention (avoidance), and the clipping device is ready for the load lifting.

After the load 16 (for example, the tall metallic pipe-column, as shown on FIG. 2) is installed and connected (for example, welded) to the appropriate constructions on the ground, the crane operator turns on the switch 15. The electromagnet 23 draws the core 12 into the coil 11 automatically unlocking the locking hook 3, opening the U-slot 29 and releasing the load sling from the clipping device. In order to release the electrical voltage from the coil 11 of the electromagnet 23, the crane operator turns off the switch 15.

Thus, an improved load clipping device provides the safe lifting of the large-size (tall) loads and quick rigging operations.

CONCLUSION, RAMIFICATION AND SCOPE

Accordingly the reader will see that, according to the invention, I have provided a load clipping device with high efficiency and safety for rigging of tall loads . An improved clipping device has various possibilities, considering activities of a remote controlled clipping hook.

While the above description contains many specificities, these should not construed as limitations on the scope of the invention, but as exemplification of the presently-preferred embodiments thereof Many other ramifications are possible within the teaching to the invention. For example, an improved clipping device can be useful for bridge pier installation and assembly, where the access to the object is difficult for an operator (for example, a rigger).

Thus, the scope of the invention should be determined by the appended claims and their legal equivalents, and not by examples given.

What is claimed is:

1. A load clipping device, including:

a locking hook connected by a main hinge to a clipping device body, having a U-slot for a load sling passage, and wherein said locking hook has a short lever;

a lever connected by a second hinge to said locking hook;

a main spring connected to said locking hook and coupled with said clipping device body;

an electromagnet, comprising a coil connected to said clipping device body and a core connected by said second hinge to said short lever;

an insert one side of which is installed into a cavity located in the end of said short lever of said locking hook and connected to said short lever by said second hinge, and the another side of said insert has a semicircular cog-wheel oriented in a vertical plane;

a lug connected by a third hinge to said clipping device body; and a switch connected by an electrical wire to said coil of said electromagnet.

2. The device of claim 1, wherein said lever, having a hollow structure, comprises a cog connected by a fourth hinge, jutting out of the lever body, to a spring, and wherein said cog is coupled with said semicircular cog-wheel.

3. The device of claim 2, wherein said lever is movable in a vertical plane with a fixation in different positions characterized by the location of said cog in said semicircular cog-wheel.

4. The device of claim 1, wherein said insert is motionless.

* * * * *